US012751523B2

(12) United States Patent
Huang et al.

(10) Patent No.: US 12,751,523 B2
(45) Date of Patent: Oct. 6, 2026

(54) QUICK-DISASSEMBLY DEVICE AND ASSEMBLING METHOD THEREOF

(71) Applicant: SZ CHI TECHNOLOGY CO., LTD., Shenzhen (CN)

(72) Inventors: Zhihan Huang, Shenzhen (CN); Yao He, Shenzhen (CN)

(73) Assignee: SZ CHI TECHNOLOGY CO., LTD., Shenzhen (CN)

( * ) Notice: Subject to any disclaimer, the term of this patent is extended or adjusted under 35 U.S.C. 154(b) by 125 days.

(21) Appl. No.: 18/780,570

(22) Filed: Jul. 23, 2024

(65) Prior Publication Data

US 2024/0373989 A1 Nov. 14, 2024

Related U.S. Application Data

(63) Continuation-in-part of application No. PCT/CN2023/071651, filed on Jan. 10, 2023.

(30) Foreign Application Priority Data

Jan. 25, 2022 (CN) ..... 202210087775.1

(51) Int. Cl.
*A44B 11/25* (2006.01)

(52) U.S. Cl.
CPC ..... *A44B 11/258* (2013.01); *A44D 2203/00* (2013.01)

(58) Field of Classification Search
CPC ..... A44B 11/258; A44D 2203/00
See application file for complete search history.

(56) References Cited

U.S. PATENT DOCUMENTS

| | | | | |
|---|---|---|---|---|
| 6,871,517 | B2 * | 3/2005 | Bonelli | A44B 11/266 24/166 |
| 2020/0315274 | A1 | 10/2020 | Yarger | |
| 2025/0228290 | A1 * | 7/2025 | Kong | A24F 40/90 |
| 2025/0230826 | A1 * | 7/2025 | Tu | F16M 11/041 |

FOREIGN PATENT DOCUMENTS

| | | | | |
|---|---|---|---|---|
| CN | 102292006 | A | 12/2011 | |
| CN | 210203582 | U | 3/2020 | |
| CN | 213074731 | U | 4/2021 | |
| CN | 114027582 | A * | 2/2022 | A44B 11/2546 |
| CN | 116565629 | A * | 8/2023 | A61L 9/03 |
| CN | 221690271 | U * | 9/2024 | |
| KR | 102188857 | B1 * | 12/2020 | A45C 13/10 |

OTHER PUBLICATIONS

International Search Report of PCT Patent Application No. PCT/CN2023/071651 issued on Apr. 6, 2023.

* cited by examiner

*Primary Examiner* — Mark A Williams

(57) ABSTRACT

The disclosure provides a quick-disassembly device, comprising a connector, a carrier and a limiting assembly. The carrier is provided with an accommodating cavity and a limiting cavity; the connector is movably arranged with the carrier relatively, in an entering state, the connector is at least partially accommodated in the accommodating cavity, and in a locking state, the connector is at least partially accommodated in the limiting cavity and relatively fixed with the carrier; the limiting assembly comprises a first connecting block and a second connecting block, and in the locking state, the connector is abutted against an inner wall of the limiting cavity under a magnetic force between the first connecting block and the second connecting block, and is fixed in the limiting cavity.

20 Claims, 7 Drawing Sheets

QUICK-DISASSEMBLY DEVICE AND ASSEMBLING METHOD THEREOF

CROSS REFERENCE TO RELATED APPLICATIONS

The present application is a Continuation-In-Part Application of PCT Application No. PCT/CN2023/071651 filed on Jan. 10, 2023, which claims the benefit of Chinese Patent Application No. 202210087775.1 filed on Jan. 25, 2022. All the above are hereby incorporated by reference in their entirety.

TECHNICAL FIELD

The present disclosure relates to the technical field of quick-disassembly devices, and in particular to a quick-disassembly device and an assembling method thereof.

BACKGROUND

Quick-disassembly connectors are usually applied to objects that need to be moved, such as cameras and keys, so that users can quickly separate or connect with the objects. Traditional quick-disassembly connectors usually use elastic elements to realize a clamping function. After the quick-disassembly connectors move into carrying structures, the elastic elements can provide elastic force to drive the quick-disassembly connectors to connect with the carrying structures, and then an unlocking function can be realized by overcoming the elastic force of the elastic elements.

Because of frequent friction between the quick-disassembly connectors and the carrying structures and/or the elastic elements, or elastic fatigue change of the elastic elements themselves, fixing reliability and consistency of the quick-disassembly connector cannot be guaranteed, and a using effect is not good.

SUMMARY

In view of this, the present disclosure provides a quick-disassembly device and an assembling method thereof, which are used to solve problems that reliability and consistency of the traditional quick-disassembly connector are easy to change due to frequent friction, and a using effect is not good.

The present disclosure provides a quick-disassembly device, comprising:

a carrier provided with an accommodating cavity and a limiting cavity which are communicated;

a connector movably arranged with the carrier relatively, wherein at least an entering state and a locking state are provided on a moving path of the connector, in the entering state, the connector is at least partially accommodated in the accommodating cavity, and in the locking state, the connector is at least partially accommodated in the limiting cavity and relatively fixed with the carrier; and a limiting assembly, comprising a first connecting block and a second connecting block, wherein the first connecting block is arranged in the connector, and the second connecting block is arranged on the carrier; and in the locking state, the connector is abutted against an inner wall of the limiting cavity under a magnetic force between the first connecting block and the second connecting block, and is fixed in the limiting cavity.

According to one embodiment of the present disclosure, the first connecting block is a first magnetic piece and the second connecting block is a second magnetic piece; the first magnetic piece is provided with a first magnetic pole and a second magnetic pole with different polarities, the second magnetic piece is provided with a third magnetic pole and a fourth magnetic pole with different polarities, and the first magnetic pole and the third magnetic pole have the same magnetism, and the first magnetic pole and the second magnetic pole are arranged along a direction from the accommodating cavity to the limiting cavity; in the entering state, the second magnetic pole and the third magnetic pole attract each other, and in the locking state, the first magnetic pole and the fourth magnetic pole attract each other, while the second magnetic pole has the same polarity as the fourth magnetic pole, and drives the connector to be abutted against the inner wall of the limiting cavity.

According to one embodiment of the present disclosure, the second magnetic piece comprises a first magnetic part and a second magnetic part, the first magnetic part and the second magnetic part are sequentially arranged along the direction from the accommodating cavity to the limiting cavity, the third magnetic pole is located on one side of the first magnetic part towards the accommodating cavity, and the fourth magnetic pole is located on one side of the second magnetic part towards the limiting cavity; the first magnetic part is further provided with a sixth magnetic pole, the sixth magnetic pole is located on one side of the third magnetic pole far from the accommodating cavity, the second magnetic part is further provided with a fifth magnetic pole, and the fifth magnetic pole is located on one side of the fourth magnetic pole far from the limiting cavity.

According to one embodiment of the present disclosure, the first magnetic part and the second magnetic part are integrally formed, and the second magnetic piece is made by multipole magnetizing processing; or, the first magnetic part and the second magnetic part are separately arranged.

According to one embodiment of the present disclosure, the carrier comprises a carrier body and a limiting flange, the accommodating cavity is opened on the carrier body, and the limiting flange at least partially extends towards an inner side of the carrier body and encloses with the carrier body to form the limiting cavity; the connector comprises a connector body and a limiting peripheral part, the limiting peripheral part is convexly arranged on an outer wall of the connector body, and in the locking state, the limiting peripheral part is abutted against an inner side of the limiting flange under the drive of the limiting assembly.

According to one embodiment of the present disclosure, the limiting flange comprises a limiting part and a guide part, the guide part is connected to the limiting part and the guide part extends from the carrier body to the accommodating cavity, the limiting part extends from the carrier body to the limiting cavity, and when the connector is switched between the entering state and the locking state, the connector is in sliding fit with the guide part; and in the locking state, the limiting part is abutted against the limiting peripheral part.

According to one embodiment of the present disclosure, the carrier further comprises limiting protrusions, the limiting protrusions are arranged in the accommodating cavity, and in the locking state, one end of the connector far from the limiting cavity is abutted against the limiting protrusions, a number of the limiting protrusions is at least two, and two of the limiting protrusions are symmetrically arranged on two opposite side walls of the accommodating cavity.

According to one embodiment of the present disclosure, the connector further comprises a clamping part, and the clamping part is convexly arranged at a front end of the connector body; the carrier body is provided with a clamping slot communicated with the limiting cavity, and the clamping part is at least partially accommodated in the clamping slot in the locking state.

According to one embodiment of the present disclosure, the quick-disassembly device further comprises a pulling rope, the pulling rope passes through the connector from the clamping part, and in the locking state, the pulling rope passes through the clamping slot.

According to one embodiment of the present disclosure, the first connecting block is a first magnetic piece, and the first magnetic piece is magnetically attracted with the second connecting block, and in the locking state, the connector is fixed on the carrier by a magnetic action of the limiting assembly.

According to one embodiment of the present disclosure, the second connecting block is made of a ferromagnetic material.

According to one embodiment of the present disclosure, the second connecting block is a second magnetic piece; the first magnetic piece is provided with a first magnetic pole and a second magnetic pole with different polarities, the second magnetic piece is provided with a third magnetic pole and a fourth magnetic pole with different polarities, and the first magnetic pole and the fourth magnetic pole have the same magnetism; in the entering state, polarities of the second magnetic pole and the third magnetic pole are different, and in the locking state, the first magnetic pole and the third magnetic pole repel each other and drive the connector to be abutted against the inner wall of the limiting cavity; wherein a direction of the first magnetic pole towards the second magnetic pole is perpendicular to a direction of the third magnetic pole towards the fourth magnetic pole.

According to one embodiment of the present disclosure, a number of the first connecting blocks is two, and the two first connecting blocks are symmetrically arranged on two opposite sides of the connector; in the locking state, one of the first connecting blocks is located on one side of the connector towards the second connecting block, and the other first connecting block is located on one side of the connector far from the second connecting block.

According to one embodiment of the present disclosure, the first connecting block is a first magnetic piece and the second connecting block is a second magnetic piece; the first magnetic piece is provided with a first magnetic pole and a second magnetic pole with different polarities, the second magnetic piece is provided with a third magnetic pole and a fourth magnetic pole with different polarities, and the first magnetic pole and the third magnetic pole have the same magnetism; in the entering state, the second magnetic pole and the fourth magnetic pole repel each other, and in the locking state, the first magnetic pole and the fourth magnetic pole attract each other, while the second magnetic pole and the third magnetic pole attract each other, and drive the connector to be abutted against the inner wall of the limiting cavity; wherein a direction of the first magnetic pole towards the second magnetic pole is parallel to a direction of the third magnetic pole towards the fourth magnetic pole.

According to one embodiment of the present disclosure, the second connecting block is a second magnetic piece; the first magnetic piece is provided with a first magnetic pole and a second magnetic pole with different polarities, the second magnetic piece is provided with a third magnetic pole and a fourth magnetic pole with different polarities, and the first magnetic pole and the third magnetic pole have the same magnetism; the third magnetic pole is located on one side towards the limiting cavity; in the entering state, the second magnetic pole and the third magnetic pole attract each other, and in the locking state, the first magnetic pole and the third magnetic pole repel each other and drive the connector to be abutted against the inner wall of the limiting cavity; wherein a direction of the first magnetic pole towards the second magnetic pole is perpendicular to a direction of the third magnetic pole towards the fourth magnetic pole.

According to one embodiment of the present disclosure, the connector is mirror symmetrical with a first symmetry plane, and the first symmetry plane is a plane constructed in a length direction and a width direction of the connector.

According to one embodiment of the present disclosure, a number of the first connecting blocks is multiple, the first connecting blocks are mirror symmetrical with a first symmetry plane, and the first symmetry plane is a plane constructed in a length direction and a width direction of the connector.

According to one embodiment of the present disclosure, during the movement of the connector from the entering state to the locking state, the connector reversely flips relative to the carrier towards a direction close to the second connecting block; or during the movement of the connector from the entering state to the locking state, the connector moves in a direction parallel to the second connecting block.

According to one embodiment of the present disclosure, a rear side of the connector is provided with a shifting slot.

The present disclosure further provides an assembling method of the quick-disassembly device, wherein the assembling method comprises:

in the entering state, at least partially accommodating the connector in the accommodating cavity, wherein the connector is connected with the carrier through attraction of the second magnetic pole and the third magnetic pole;

pushing the connector to move towards the limiting cavity, wherein the first magnetic pole and the third magnetic pole repel each other, and the second magnetic pole and the fourth magnetic pole repel each other to prevent the connector from continuously moving; and continuously pushing the connector to the locking state, wherein the connector is at least partially accommodated in the limiting cavity, and the first magnetic pole and the fourth magnetic pole attract each other, so that the connector is relatively fixed with the carrier.

The implementation of the embodiments of the present disclosure has the following beneficial effects:

In the quick-disassembly device of the embodiments, the first connecting block and the second connecting block are arranged between carrier and the connector for magnetic cooperation. When the connector moves to the locking state, the fixing between the connector and the carrier can be realized through the magnetic force provided by the first connecting block and the second connecting block. Compared with a traditional quick-disassembly connector, an effect of reducing wear is achieved, so that the reliability and consistency of the quick-disassembly device are improved and the using effect is good.

BRIEF DESCRIPTION OF THE DRAWINGS

In order to illustrate the technical solutions in the specific embodiments of the present disclosure or in the related art more clearly, the drawings used in the description of the specific embodiments or the prior art will be briefly described below. Obviously, the drawings in the following description are merely some embodiments of the present disclosure. For those of ordinary skills in the art, other drawings may also be obtained based on these drawings without going through any creative work.

Wherein.

REFERENCE NUMERALS

10—quick-disassembly device;

100—connector; 110—connector body; 120—limiting peripheral part; 130—clamping part; and 140—shifting slot;

200—carrier; 210—carrier body; 211—accommodating cavity; 212—limiting cavity; 213—clamping slot; 220—limiting flange; 221—limiting part; 222—guide part; and 230—limiting protrusion;

300—limiting assembly; 300*a*—first connecting block; 300*b*—second connecting block; 310—first magnetic piece; 310*a*—first magnetic pole; 310*b*—second magnetic pole; 320—second magnetic piece; 320*a*—third magnetic pole; 320*b*—fourth magnetic pole; 320*c*—fifth magnetic pole; 320*d*—sixth magnetic pole; 321—first magnetic part; and 322—second magnetic part; and

400—pulling rope.

DETAILED DESCRIPTION

The following clearly and completely describes the technical solutions of the present disclosure with reference to the drawings. Apparently, the described embodiments are merely some but not all of the embodiments of the present disclosure. Based on the embodiments of the present disclosure, all other embodiments obtained by those of ordinary skills in the art without going through any creative work shall fall within the protection scope of the present disclosure.

Figure 1:
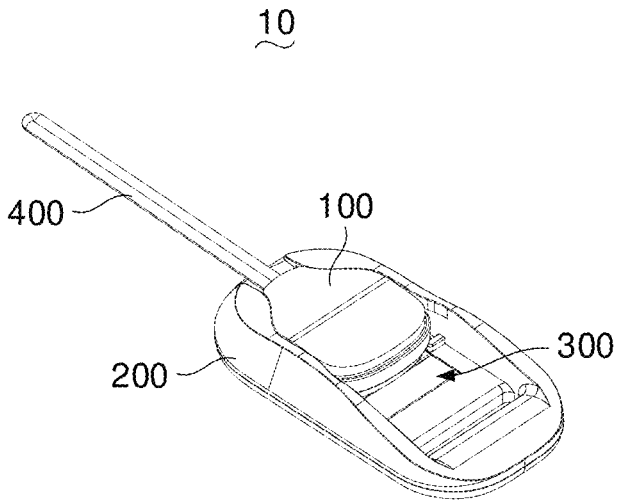
FIG. 1 is an axial side view of a quick-disassembly device in one embodiment of the present disclosure.
Figure 2:
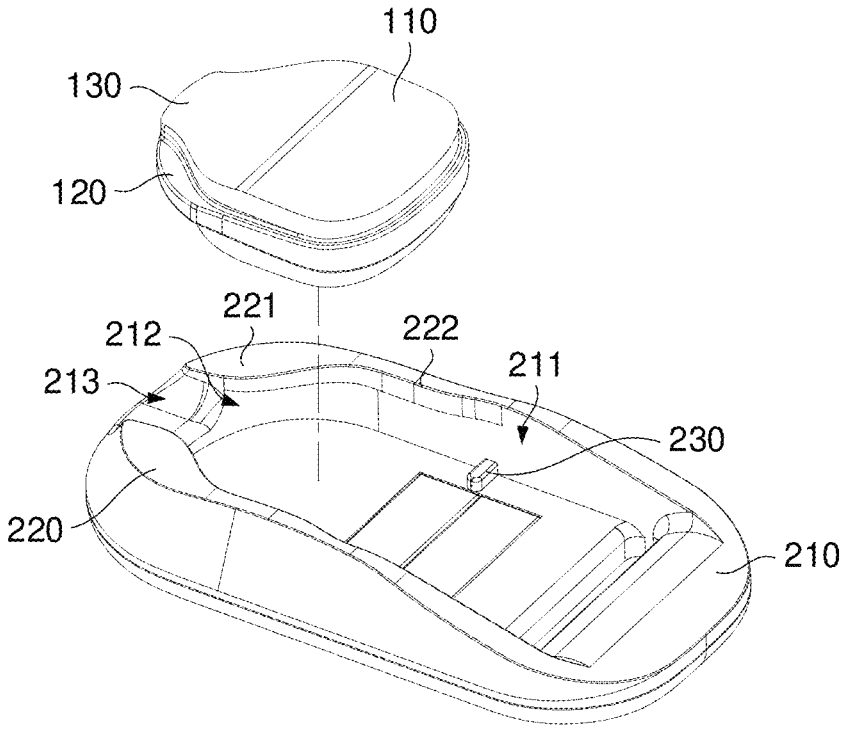
FIG. 2 is an exploded view of the quick-disassembly device in one embodiment of the present disclosure.
Figure 3:
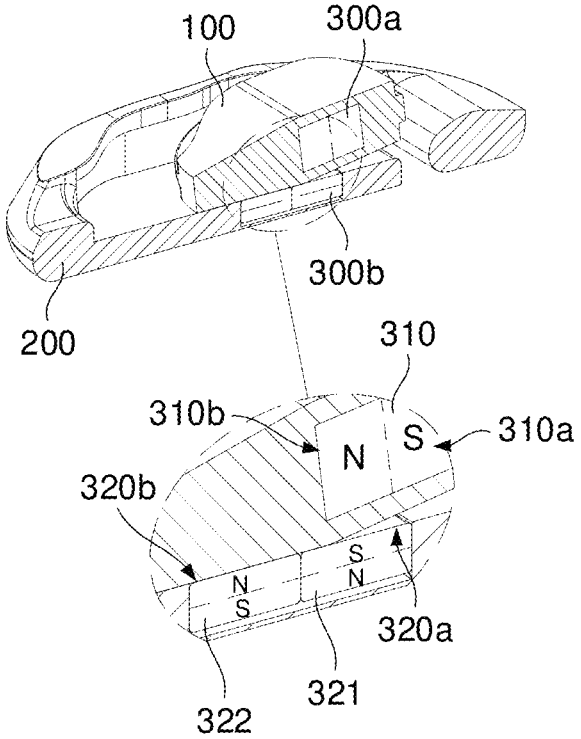
FIG. 3 is a schematic sectional view of the quick-disassembly device in one embodiment of the present disclosure in an entering state.

As shown in FIG. 1 to FIG. 3, the embodiments of the present disclosure provide a quick-disassembly device 10, which comprises a connector 100, a carrier 200 and a limiting assembly 300. The connector 100 and the carrier 200 are used to connect with at least two external members respectively and to realize connection and separation between the two. The limiting assembly 300 is used to fix the connector 100 on the carrier 200. The carrier 200 is provided with an accommodating cavity 211 and a limiting cavity 212 which are communicated. The connector 100 is movably arranged with the carrier 200 relatively, and at least an entering state and a locking state are provided on a moving path of the connector 100. In the entering state, the connector 100 is at least partially accommodated in the accommodating cavity 211, and in the locking state, the connector 100 is at least partially accommodated in the limiting cavity 212 and relatively fixed with the carrier 200. The limiting assembly 300 comprises a first connecting block 300*a* and a second connecting block 300*b*. The first connecting block 300*a* is arranged in the connector 100, and the second connecting block 300*b* is arranged on the carrier 200. In the locking state, the connector 100 is abutted against an inner wall of the limiting cavity 212 under a magnetic force between the first connecting block 300*a* and the second connecting block 300*b*, and is fixed in the limiting cavity 212.

In the quick-disassembly device 10 of the embodiments, the first connecting block 300*a* and the second connecting block 300*b* are arranged between carrier 200 and the connector 100 for magnetic cooperation. When the connector 100 moves to the locking state, the fixing between the connector 100 and the carrier 200 can be realized through the magnetic force provided by the first connecting block 300*a* and the second connecting block 300*b*. Compared with a traditional quick-disassembly connector, an effect of reducing wear is achieved, so that the reliability and consistency of the quick-disassembly device 10 are improved and the using effect is good.

As shown in FIG. 3, in one embodiment, the first connecting block 300*a* is a first magnetic piece 310 and the second connecting block 300*b* is a second magnetic piece 320. The first magnetic piece 310 is provided with a first magnetic pole 310*a* and a second magnetic pole 310*b* with different polarities. The first magnetic pole 310*a* and the second magnetic pole 310*b* are arranged along a direction from the accommodating cavity 211 to the limiting cavity 212. The second magnetic piece 320 is provided with a third magnetic pole 320*a* and a fourth magnetic pole 320*b* with different polarities, and the first magnetic pole 310*a* and the third magnetic pole 320*a* have the same magnetism, and the third magnetic pole 320*a* and the fourth magnetic pole are arranged along the direction from the accommodating cavity 211 to the limiting cavity 212. In the entering state, the second magnetic pole 310*b* and the third magnetic pole 320*a* attract each other, and in the locking state, the first magnetic pole 310*a* and the fourth magnetic pole 320*b* attract each other, while the second magnetic pole 310*b* has different polarity as the fourth magnetic pole 320*b* to drive the connector 100 to be abutted against the inner wall of the limiting cavity 212.

With this arrangement, when the connector 100 moves on the carrier body 210, the first magnetic piece 310 and the second magnetic piece 320 can provide the connector 100 with functions of magnetic guidance, balanced stress, limiting and the like when the connector 100 moves to different positions through the cooperation of the first magnetic piece 310 and the second magnetic piece 320, so that the connector 100 can be conveniently connected and fixed with the carrier 200, and the using effect is good. In the magnetic guidance stage, the second magnetic pole 310*b* and the third magnetic pole 320*a* attract each other, so that the first magnetic piece 310 and the second magnetic piece 320 attract each other. In the balanced stress stage, the first magnetic pole 310*a* and the third magnetic pole 320*a* repel each other, and the second magnetic pole 310*b* and the fourth magnetic pole 320*b* repel each other, so that the first magnetic piece 310 and the second magnetic piece 320 repel each other to prevent the first magnetic piece 100 from continuously moving. In the limiting stage, the first magnetic pole 310*a* and the fourth magnetic pole 320*b* attract each other, so that the first magnetic piece 310 and the second magnetic piece 320 attract each other. In the whole assembly process, the first magnetic piece 310 and the second magnetic piece 320 attract each other first, and then repel each other, and finally attract each other again, so that a user can clearly know a changing trend of force, thus determining whether the connector 100 is assembled to the limiting cavity 212 and abutted against the inner wall of the limiting cavity 212.

In order to make those skilled in the art have a better understanding of this solution, an assembling method of the quick-disassembly device is summarized as follows:

- in the entering state, at least partially accommodating the connector in the accommodating cavity 211, wherein the connector 100 is connected with the carrier 200 through attraction of the second magnetic pole 310*b* and the third magnetic pole 320*a;*
- pushing the connector 100 to move towards the limiting cavity 212, wherein the first magnetic pole 310*a* and the third magnetic pole 320*a* repel each other, and the second magnetic pole 310*b* and the fourth magnetic pole 320*b* repel each other to prevent the connector 100 from continuously moving; and
- continuously pushing the connector to the locking state, wherein the connector 100 is at least partially accommodated in the limiting cavity 212, and the first magnetic pole 310*a* and the fourth magnetic pole 320*b* attract each other, so that the connector 100 is relatively fixed with the carrier 200.

Preferably, the first magnetic piece 310 may be embedded in the connector 100, for example, the first magnetic piece 310 is accommodated inside the connector 100 by integral injection molding, so that the first magnetic piece 100 may have not only a compact structure, and meanwhile, the first magnetic piece 310 can be prevented from accidentally coming out of the connector body 110.

In some embodiments, the second magnetic piece 320 may be embedded in the carrier body 210 and exposed to an external environment from the inner wall of the accommodating cavity 211, so that the second magnetic piece 320 can be as close as possible to the first magnetic piece 310, thus ensuring the magnetic force between the first magnetic piece 310 and the second magnetic piece 320. In a specific embodiment, a distance between the second magnetic piece 320 and the inner wall of the accommodating cavity 211 may be 0.2 mm, which is not limited herein. In a preferred embodiment, the second magnetic piece 320 may be located inside the carrier 200 by integral injection molding, so as to improve integrity between the second magnetic piece 320 and the carrier 200, and also achieve a purpose of saving a mold cost during processing.

In some embodiments, the quick-disassembly device 10 may also comprise one stator (not shown in the figure). The stator is connected to the carrier 200 and used to fix the second magnetic piece 320 in the carrier 200.

Further, as shown in FIG. 3, the second magnetic piece 320 comprises a first magnetic part 321 and a second magnetic part 322. The first magnetic part 321 and the second magnetic part 322 are sequentially arranged along the direction from the accommodating cavity 211 to the limiting cavity 212, the third magnetic pole 320*a* is located on one side of the first magnetic part 321 towards the accommodating cavity 211, and the fourth magnetic pole 320*b* is located on one side of the second magnetic part 322 towards the limiting cavity 212.

Compared with the limiting assembly 300 in the above-mentioned embodiment, in this embodiment, the second magnetic piece 320 is arranged as the first magnetic part 321 and the second magnetic part 322 which are separated, and a stronger and more stable magnetic force can be provided for the connector 100 through magnetic field coupling between the first magnetic part 321 and the second magnetic part 322. As shown in FIG. 3, the first magnetic pole 310*a* of the first magnetic piece 310 may be an S-pole (or N-pole), the second magnetic pole 310*b* of the first magnetic piece 310 may be an N-pole (or S-pole), the fourth magnetic pole 320*b* is located on one side of the second magnetic part 322 towards the accommodating cavity 211, the fourth magnetic pole 320*b* is an N-pole (or S-pole), the third magnetic pole 320*a* is located on one side of the first magnetic part 321 towards the accommodating cavity 211, and the third magnetic pole 320*a* is an S-pole (or N-pole).

Figure 7:
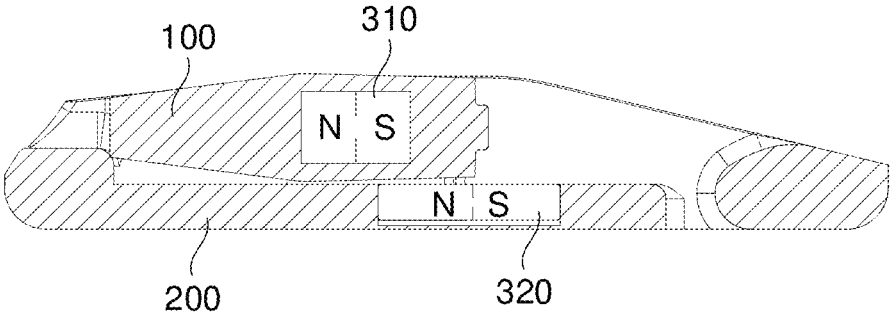
FIG. 7 is a schematic sectional view of a quick-disassembly device in another embodiment of the present disclosure.

As shown in FIG. 7, in a preferred embodiment, the second magnetic piece 320 may also be of an integrated structure, and magnetic poles of the second magnetic piece 320 are an S-pole (or N-pole) and an N-pole (or S-pole) respectively along the direction from the accommodating cavity 211 to the limiting cavity 212. With this arrangement, the second magnetic piece 320 can also be magnetically matched with the first magnetic piece 310.

Figure 8:
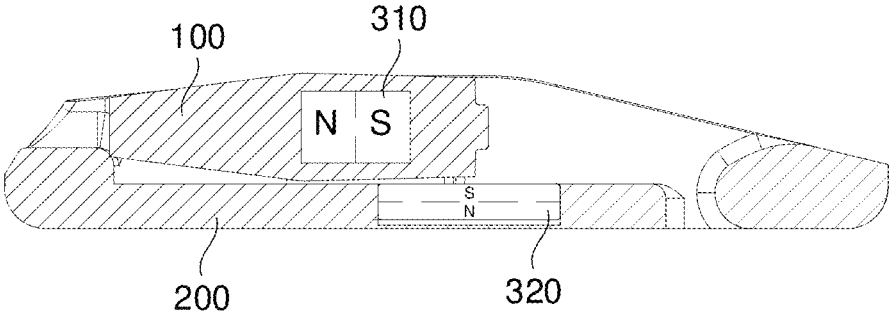
FIG. 8 is a schematic sectional view of a quick-disassembly device in yet another embodiment of the present disclosure.

As shown in FIG. 8, in another embodiment, the second magnetic piece 320 is of an integrated structure, and the N-pole (or S-pole) is located on a lower side of the second magnetic piece 320, and the S-pole (or N-pole) is located on an upper side of the second magnetic piece 320. When the quick-disassembly device 10 of this embodiment is used, the second magnetic piece 320 can adsorb the first magnetic piece 310 when the connector 100 is in the entering state. The second magnetic piece 320 and the first magnetic piece 310 may repel each other when the connector 100 is moved to the locking state, so as to drive the limiting flange 220 to be abutted against the limiting peripheral part 120, thereby ensuring a fixing function between the connector 100 and the carrier 200. Of course, in some embodiments, the second magnetic piece 320 may also be composed of three, four or more single magnets, which will not be described in detail here.

As shown in FIG. 2, in one embodiment, the carrier 200 comprises a carrier body 210 and a limiting flange 220, the accommodating cavity 211 is opened on the carrier body 210, and the limiting flange 220 at least partially extends towards an inner side of the carrier body 210 and encloses with the carrier body 210 to form the limiting cavity 212; the connector 100 comprises a connector body 110 and a limiting peripheral part 120, the limiting peripheral part 120 is convexly arranged on an outer wall of the connector body 110, and in the locking state, the limiting peripheral part 120 is abutted against an inner side of the limiting flange 220 under the drive of the limiting assembly 300.

In this embodiment, a front end of the connector body 110 is provided with an inclined plane, and the inclined plane is inclined from the connector body 110 towards a direction far from the accommodating cavity 211. When the connector 100 is in the locking state, there is an included angle between the inclined plane and the bottom surface of the accommodating cavity 211. When the connector 100 needs to be unlocked, the front end of the connector body 110 needs to be pressed to make the inclined plane adhere to the bottom surface of the accommodating cavity 211, thus realizing an unlocking function of the connector 100.

With the quick-disassembly device 10 of this embodiment, as shown in FIG. 3, in this case, the quick-disassembly device 10 is in the entering state, and the first magnetic piece 310 and the second magnetic piece 320 drive the connector 100 to move closer to the carrier 200 under the magnetic attraction of the second magnetic pole 310*b* and the third magnetic pole 320*a*, thereby assisting the user to locate a connecting position between the connector 100 and the carrier 200 and facilitating the connection between the connector 100 and the carrier 200.

Figure 4:
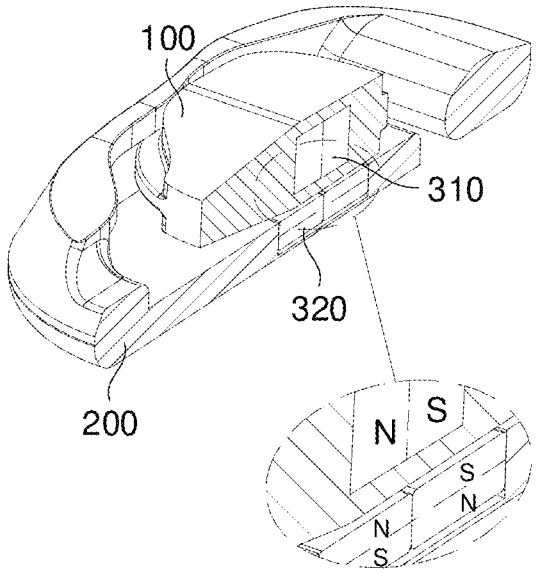
FIG. 4 is a schematic sectional view of the quick-disassembly device in one embodiment of the present disclosure in an intermediate state.

As shown in FIG. 4, when the connector 100 continuously moves along the accommodating cavity 211 until an intermediate state, in this case, the two magnetic poles of the first magnetic piece 310 and the second magnetic piece 320 repel each other, and the limiting peripheral part 120 may be abutted against the limiting flange 220, so that stress balance of the connector 100 in a vertical direction can be maintained, the carrier 200 in the connector 100 can be prevented from accidentally falling off, and the user only needs to continuously push the connector 100 to move to make the connector enter the limiting cavity 210.

Figure 5:
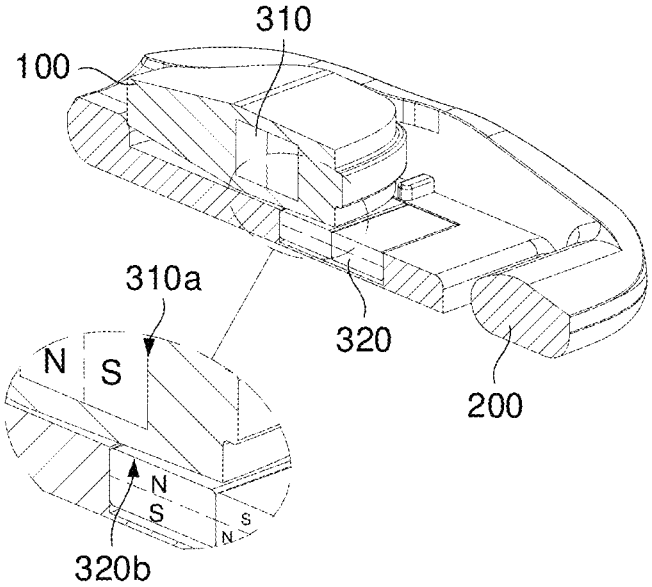
FIG. 5 is a schematic sectional view of the quick-disassembly device in one embodiment of the present disclosure in a locking state.

As shown in FIG. 5, when the connector 100 moves to the locking state, under the magnetic action of different polarities between the second magnetic pole 310*b* and the fourth magnetic pole 320*b*, a front end of the connector 100 can be abutted in the limiting cavity 212, and the limiting peripheral part 120 can be abutted against the limiting flange 220, thereby maintaining the firmness of the connection between the connector 100 and the carrier 200.

Specifically, the limiting flange 220 comprises a limiting part 221 and a guide part 222, the guide part 222 is connected to the limiting part 221 and the guide part 222 extends from the carrier body 210 to the accommodating cavity 211, the limiting part 221 extends from the carrier body 210 to the limiting cavity 212, and when the connector 100 is switched between the entering state and the locking state, the connector 100 is in sliding fit with the guide part 222; and in the locking state, the limiting part 221 is abutted against the limiting peripheral part 120.

With this arrangement, when the connector 100 is in the entering state, the connector body 110 may contact with the guide part 222 and be guided into the limiting cavity 212 via the guide part 222. In a preferred embodiment, along the direction from the accommodating cavity 211 to the limiting cavity 212, a width of the guide part 222 at an opening of the guide part 222 gradually decreases to form a trumpet-shaped guide structure. By cooperating with the trumpet-shaped guide structure, the connector 100 can realize accurate alignment and is convenient to use. It may be understood that, in this embodiment, as the guide part 222 extends towards the limiting cavity 212, when the connector 100 moves from the entering state to the locking state, the guide part 222 can also be abutted against the limiting peripheral part 120, and limit the connector 100 together by cooperating with the limiting part 221.

Figure 6:
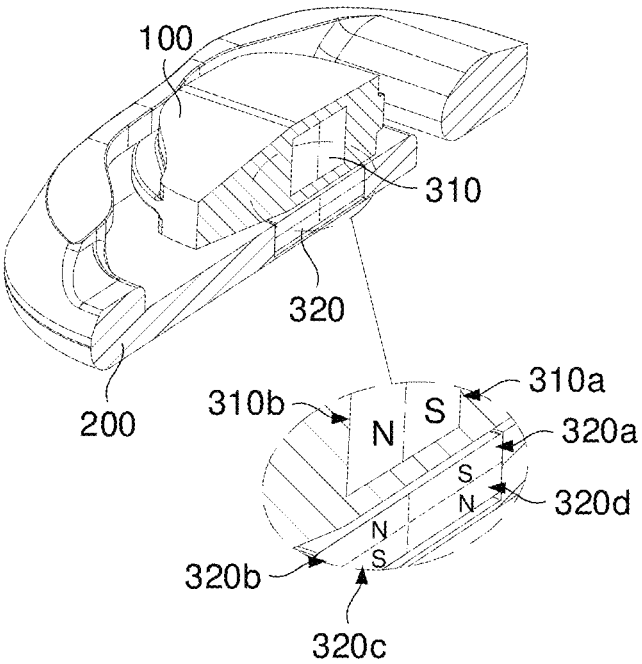
FIG. 6 is a schematic sectional view of a quick-disassembly device in a preferred embodiment of the present disclosure.

As shown in FIG. 6, in a preferred embodiment, the first connecting block 300*a* is a first magnetic piece 310 and the second connecting block 300*b* is a second magnetic piece 320. The first magnetic piece 310 is provided with a first magnetic pole 310*a* and a second magnetic pole 310*b* with different polarities. The first magnetic pole 310*a* and the second magnetic pole 310*b* are arranged along a direction from the accommodating cavity 211 to the limiting cavity 212. The second magnetic piece 320 is provided with a third magnetic pole 320*a*, a fourth magnetic pole 320*b*, a fifth magnetic pole 320*c* and a sixth magnetic pole 320*d* with different polarities, and the first magnetic pole 310*a*, the third magnetic pole 320*a* and the fifth magnetic pole 320*c* have the same magnetism. The third magnetic pole 320*a* is located on one side of the first magnetic part 321 towards the accommodating cavity 211, the fourth magnetic pole 320*b* is located on one side of the second magnetic part 322 towards the limiting cavity 212, the sixth magnetic pole 320*d* is located on one side of the third magnetic pole 320*a* far from the accommodating cavity 211, the fifth magnetic pole 320*c* is located on one side of the fourth magnetic pole 320*b* far from the accommodating cavity 211, and the second magnetic piece 320 is formed by multipole magnetizing processing. In the entering state, the second magnetic pole 310*b* and the third magnetic pole 320*a* attract each other, and in the locking state, the first magnetic pole 310*a* and the sixth magnetic pole 320*d* attract each other, and drive the connector 100 to be abutted against the inner wall of the limiting cavity 212.

It should be noted that this embodiment is different from the above-mentioned embodiment in that the first magnetic pole 310*a*, the third magnetic pole 320*a* and the fifth magnetic pole 320*c* may be S-poles (or N-poles), the second magnetic pole 310*b*, the fourth magnetic pole 320*b* and the sixth magnetic pole 320*d* may be N-poles (or S-poles), and the second magnetic piece 320 is an integral element, so that the second magnetic piece 320 forms a single-sided two-pole structure through multipole magnetizing processing. With this arrangement, when the first magnetic piece 310 and the second magnetic piece 320 are magnetically matched, an automatic positioning function can be provided for the connector 100, and a magnetic force can also be provided for the connector 100 to fix the connector on the carrier 200 in the locking state, so that the using effect is good. Due to the integrated structure of the second magnetic piece 320, the second magnetic piece 320 is not only compact in structure, but also durability of the second magnetic piece 320 is improved.

In the above embodiment, the second magnetic piece 320 is of a single-sided double-pole structure. In other embodiments, the second magnetic piece 320 may also be of a single-sided multi-pole structure. By setting the second magnetic piece 320 to be of the single-sided multi-pole structure, the second magnetic piece 320 can magnetically position the connector 100 several times on the moving path of the connector, which is not limited here.

Further, the carrier 200 further comprises limiting protrusions 230, the limiting protrusions 230 are arranged in the accommodating cavity 211, and in the locking state, one end of the connector 100 far from the limiting cavity 212 is abutted against the limiting protrusions 230. Specifically, the limiting protrusions 230 are arranged on a bottom surface of the accommodating cavity 211.

When using the connector 100 of this embodiment, when the connector 100 moves to the locking state, the limiting protrusion 230 may be abutted against a rear side of the connector body 110 to limit the movement of the connector 100 in the direction from the limiting cavity 212 to the accommodating cavity 211. When it is necessary to remove the connector 100 from the carrier 200, the user can press the front end of the connector 100 to make the first magnetic piece 310 overcome the magnetic force of the second magnetic piece 320 and tilt a rear end of the connector 100. In this case, the connector 100 is separated from the limiting protrusion 230, and the user can conveniently withdraw the connector 100 from the limiting cavity 212.

In one embodiment, a number of the limiting protrusions 230 is at least two, and two of the limiting protrusions 230 are symmetrically arranged on two opposite side walls of the accommodating cavity 211.

It can be understood that by arranging the at least two limiting protrusions 230 on the carrier body 210, when the connector 100 is in the locking state, all the plurality of limiting protrusions 230 can be abutted against the connector 100, so as to provide a stable supporting force for the connector 100, thereby improving the firmness of the connection between the connector 100 and the carrier 200.

In other embodiments, only one limiting protrusion 230 can be provided. When the connector 100 moves to the locking state, the limiting protrusion 230 can be abutted against an outer wall of the connector 100 to limit the movement of the connector 100. Of course, there may be more than two limiting protrusions 230, which is not limited here.

Further, as shown in FIG. 1 and FIG. 2, the connector 100 further comprises a clamping part 130, and the clamping part 130 is convexly arranged at the front end of the connector body 110; the carrier body 210 is provided with a clamping slot 213 communicated with the limiting cavity 212, and the clamping part 130 is at least partially accommodated in the clamping slot 213 in the locking state.

In this embodiment, by arranging the clamping part 130 to match with the clamping slot 213, when the connector 100 is in the locking state, the connector 100 and the carrier 200 may have a compact structure, which is convenient to accommodate or use. At the same time, as the clamping part 130 is at least partially accommodated in the clamping slot 213, accidental separation of the connector 100 due to bumping can be avoided, and the connection reliability of the quick-disassembly device 10 can be improved. Specifically, in this embodiment, the clamping slot 213 extends towards a space between the limiting protrusions 230. Therefore, as shown in FIG. 1, in this embodiment, at least part of the clamping part 130 is located in the clamping slot 213 (that is, part of the clamping part 130 located on an upper side of the limiting cavity 212), and in other embodiments, a front end of the clamping part 130 may also extend outwards. In the locking state, the front end of the clamping part 130 extends from the limiting cavity 212 towards the clamping slot 213, which is not limited here.

Still further, the quick-disassembly device 10 further comprises a pulling rope 400, the pulling rope 400 passes through the connector 100 from the clamping part 130, and in the locking state, the pulling rope 400 passes through the clamping slot 213.

It can be understood that by arranging the pulling rope 400, when using the quick-disassembly device 10, the quick-disassembly device can be connected with an external device through the pulling rope 400, and the carrier 200 can be connected with another device or structure through a fixing belt (not shown in the figure) to realize the connection or separation between them. Preferably, the pulling rope 400 may be an elastic pulling rope or a steel wire pulling rope, which is specifically selected according to a use environment of the quick-disassembly device 10, which is not limited here.

As shown in FIG. 8, in one embodiment, this embodiment is improved based on the embodiment of FIG. 6, and the second connecting block 300*b* is a second magnetic piece 320. The first magnetic piece 310 is provided with a first magnetic pole 310*a* and a second magnetic pole 310*b* with different polarities. The first magnetic pole 310*a* and the second magnetic pole 310*b* are arranged along a direction from the accommodating cavity 211 to the limiting cavity 212. The second magnetic piece 320 is provided with a third magnetic pole 320*a* and a fourth magnetic pole 320*b* with different polarities, the first magnetic pole 310*a* and the third magnetic pole 320*a* have the same magnetism, and the third magnetic pole 320*a* and the fourth magnetic pole are arranged along a sliding direction perpendicular to the connector 100. The third magnetic pole 320*a* is located on one side towards the limiting cavity 212. In the entering state, the second magnetic pole 310*b* and the third magnetic pole 320*a* attract each other, and in the locking state, the first magnetic pole 310*a* and the third magnetic pole 320*a* repel each other, and drive the connector 100 to be abutted against the inner wall of the limiting cavity 212. A direction of the first magnetic pole 310*a* towards the second magnetic pole 310*b* is perpendicular to a direction of the third magnetic pole 320*a* towards the fourth magnetic pole 320*b*.

Specifically, according to the arrangement of the magnetic poles as shown in FIG. 8, the quick-disassembly device 10 in this embodiment is preferably connected or detached along a horizontal direction. When a magnetic pole direction of the first magnetic piece 310 in FIG. 8 is reversed, the first magnetic piece 310 can be magnetically attracted to and fixed with the second magnetic piece 320 in the locking state.

Figure 9:
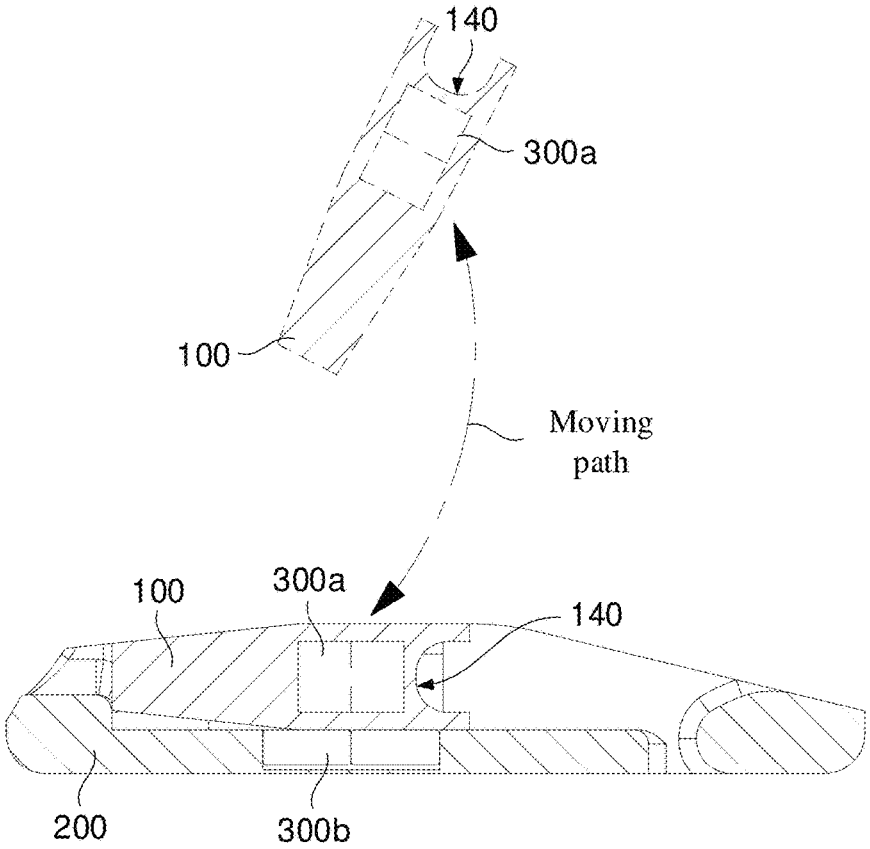
FIG. 9 is a schematic sectional view of a quick-disassembly device in another embodiment of the present disclosure.

As shown in FIG. 9, in another embodiment, the first connecting block 300*a* is magnetically attracted with the second connecting block 300*b*, and in the locking state, the connector 100 is fixed on the carrier 200 by the magnetic attraction of the limiting assembly 300.

When installing the connector 100 and the carrier 200 of the quick-disassembly device 10 of this embodiment, firstly, the front end of the connector 100 is tilted, so that the first connecting block 300*a* is magnetically attracted with the second connecting block 300*b*, and then the connector 100 can be fixed on the carrier 200. When the connector 100 and the carrier 200 need to be separated, the connector 100 and the carrier 200 can be separated by first pressing the front end of the connector 100 to overcome the magnetic attraction between the first connecting block 300*a* and the second connecting block 300*b*, and then driving the connector 100 to move away from the carrier 200 along the moving path of the connector 100.

When connecting the connector 100 and the carrier 200 in this embodiment, the connector 100 is placed close to the carrier 200, and the connector 100 can be automatically attracted to a corresponding connecting position of the carrier 200, such as the accommodating cavity 211, under the magnetic attraction between the first connecting block 300*a* and the second connecting block 300*b*.

Further, a rear side of the connector 100 is provided with a shifting slot 140.

When using the quick-disassembly device 10 of this embodiment, when the connector 100 needs to be separated from the carrier 200, a finger may be placed in the shifting slot 140, so that the rear end of the connector 100 can be easily shifted to be separated from the carrier 200.

Figure 10:
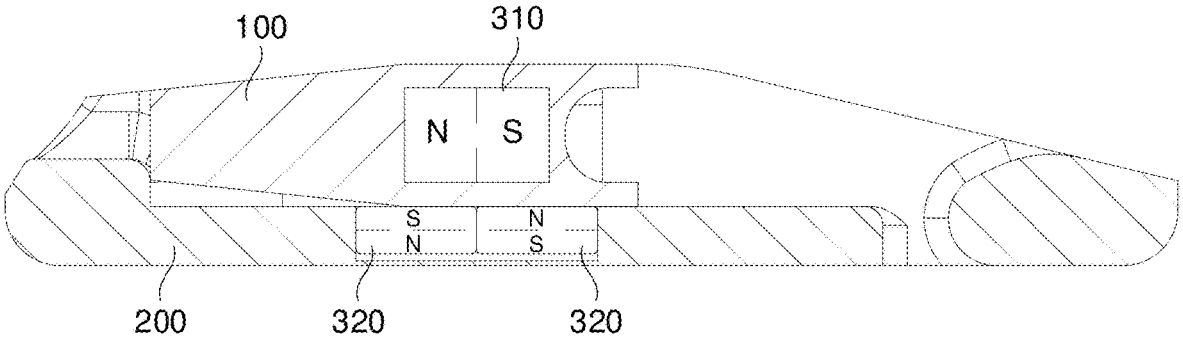
FIG. 10 is a schematic layout diagram of a limiting assembly of a quick-disassembly device in some embodiments of the present disclosure.

As shown in FIG. 10, in this embodiment, the first connecting block 300*a* is a first magnetic piece 310, and the second connecting block 300*b* is a second magnetic piece 320. When the connector 100 is in the locking state, the first magnetic piece 310 can be magnetically attracted with the second magnetic piece 320, and the front end of the connector 100 can be positioned through the cooperation of the limiting peripheral part 120 and the limiting flange 220, so that the limiting assembly 300 can magnetically fix the rear end of the connector 100, thereby fixing the connector 100 on the carrier 200. The quick-disassembly device 10 of this embodiment can realize automatic attraction and positioning functions, and is convenient to assemble and disassemble.

Specifically, in this embodiment, a number of the second magnetic piece 320 is two, the two second magnetic pieces 320 are arranged in sequence along the horizontal direction in the figure, and magnetic poles of the two second magnetic pieces 320 are opposite. As shown in FIG. 10, an S-pole (or N-pole) of the first magnetic piece 310 is located on a right side of the first magnetic piece 310, and an N-pole (or S-pole) of the first magnetic piece 310 is located on a left side of the first magnetic piece 310. An S-pole (or N-pole) of the second magnetic piece 320 located on the left side is located on one side towards the first magnetic piece 310, and an N-pole (or S-pole) of the second magnetic piece 320 located on the right side is located on one side towards the first magnetic piece 310, so that the magnetic attraction connection between the first magnetic piece 310 and the second magnetic piece 320 can be realized.

Figure 11:
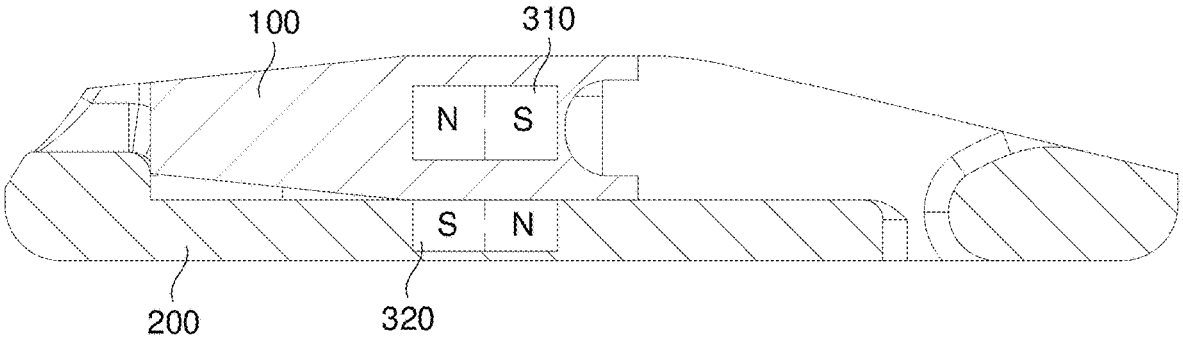
FIG. 11 is a schematic layout diagram of the limiting assembly of the quick-disassembly device in some embodiments of the present disclosure.

As shown in FIG. 11, in one embodiment, the first connecting block 300*a* is a first magnetic piece 310 and the second connecting block 300*b* is a second magnetic piece 320, and both numbers of the two may be one; Specifically, in this embodiment, an N-pole (or S-pole) of the first magnetic piece 310 is located on a left side of the first magnetic piece 310, and an S-pole (or N-pole) of the first magnetic piece 310 is located on a right side of the first magnetic piece 310. A magnetic pole of the second magnetic piece 320 is opposite to that of the first magnetic piece 310.

Figure 12:
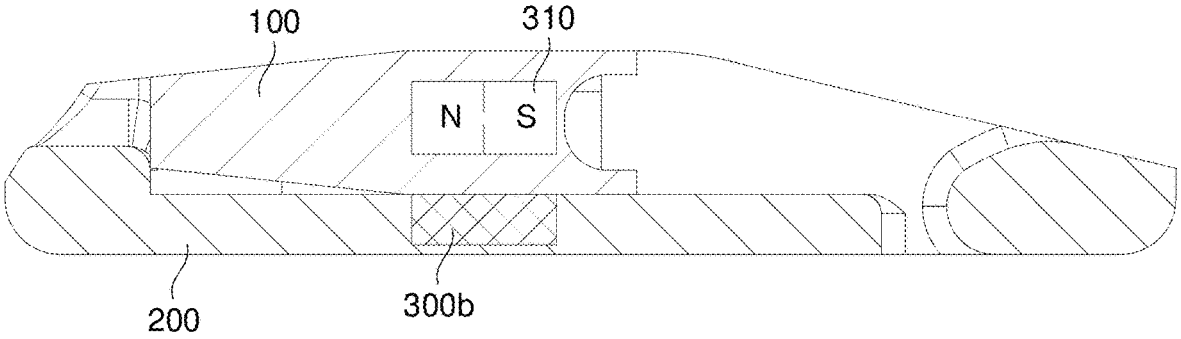
FIG. 12 is a schematic layout diagram of the limiting assembly of the quick-disassembly device in some embodiments of the present disclosure.

As shown in FIG. 12, in one embodiment, the first connecting block 300*a* is a first magnetic piece 310 and the second connecting block 300*b* is a magnetically attractable metal. With this arrangement, when the connector 100 is in the locking state, the first magnetic piece 310 may be magnetically attracted with the second connecting block 300*b* to realize a fixing function of the connector 100. In other embodiments, the first connecting block 300*a* may also be a magnetically attractable metal, so that the first connecting block can be magnetically attracted by a magnetic piece. The second connecting block 300*b* is a second magnetic piece 320, which can also realize the magnetic attraction and fixing functions of the limiting assembly 300, which will not be described in detail here.

Figure 13:
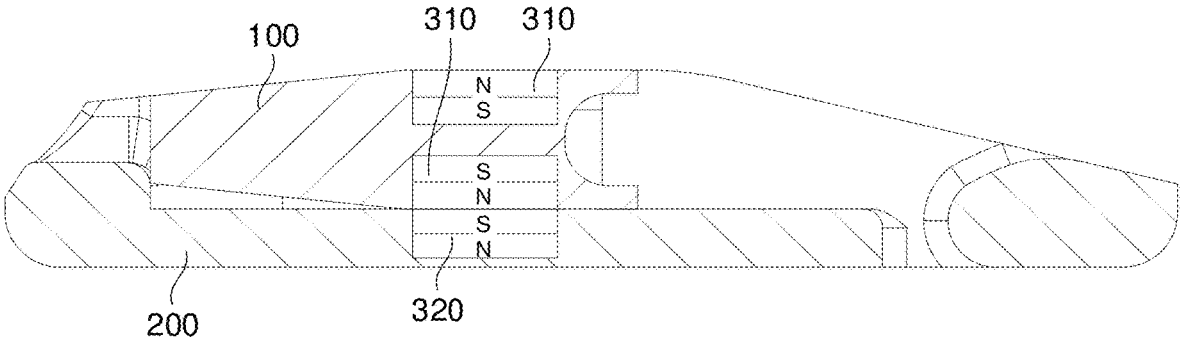
FIG. 13 is a schematic layout diagram of the limiting assembly of the quick-disassembly device in some embodiments of the present disclosure.

As shown in FIG. 13, a number of the first connecting block 300*a* is two, and the two first connecting blocks 300*a* are symmetrically arranged on opposite sides of the connector 100. In the locking state, one of the first connecting blocks 300*a* is located on one side of the connector 100 towards the second connecting block 300*b*, and the other first connecting block 300*a* is located on one side of the connector 100 far from the second connecting block 300*b*.

In this embodiment, a magnetic pole of the first magnetic piece 310 towards an outer side of the connector 100 is an S-pole (or N-pole), and a magnetic pole of the second magnetic piece 320 towards the accommodating cavity 211 is an N-pole (or S-pole). With this arrangement, when the connector 100 is turned over, one first magnetic piece 310 and one second magnetic piece 320 can be magnetically attracted correspondingly, so that the magnetic force when the connector 100 is connected with the carrier 200 in different directions can be improved, and the using effect is good.

Figure 14:
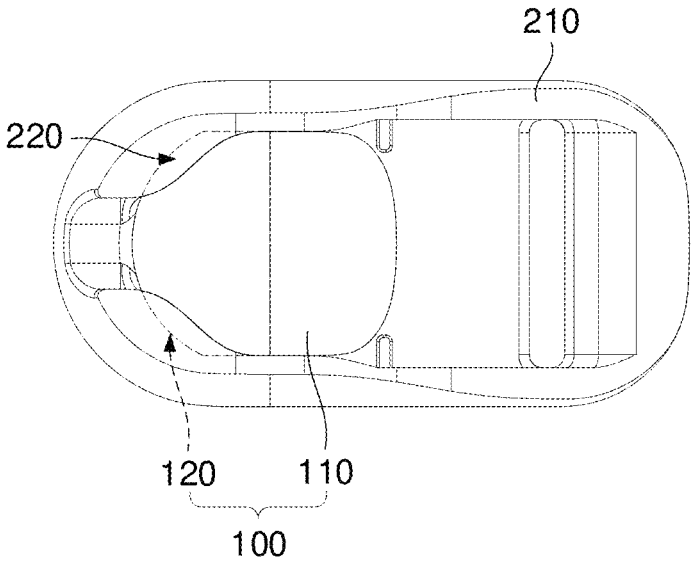
FIG. 14 is a schematic top view of the quick-disassembly device in some embodiments of the present disclosure.

As shown in FIG. 14, in this embodiment, the limiting peripheral part 120 of the connector 100 can be only arranged at the front end of the connector body 110, and a setting range of the limiting edge 220 of the carrier 200 only corresponds to the limiting peripheral part 120. When the connector 100 and the carrier 200 move relatively, a side wall of the connector body 110 and the inner wall of the accommodating cavity 211 are parallel to each other.

With this arrangement, as shown in FIG. 9, when the connector 100 is withdrawn from the carrier 200 along the moving path, because the inner wall of the accommodating cavity 211 is not provided with a section of limiting flange 220, the connector 100 can be avoided, so as to facilitate withdrawing the connector 100 smoothly. Specifically, as shown in FIG. 2 to FIG. 13, the connector 100 is mirror symmetrical with a first symmetry plane, and the first symmetry plane is a plane constructed in a length direction and a width direction of the connector 100. In other words, upper and lower parts of the connector 100 are mirror symmetrical.

With this arrangement, when the first symmetrical plane is parallel to the bottom surface of the accommodating cavity 211, the connector 100 has at least two installation modes. As a placing state shown in FIG. 2, the connector 100 may move towards the carrier 200 and be connected along the vertical direction, and the connector 100 may also be turned over by 180 degrees along an axis parallel to a horizontal plane. In this case, the structure of the connector 100 is the same as that before being turned over, and the first magnetic pole 310*a* and the second magnetic pole 310*b* are arranged along the direction from the accommodating cavity 211 to the limiting cavity 212. Therefore, when using the connector 100, the connector can be assembled on the carrier 200 without corresponding to positive and negative directions of the connector, so that the using convenience is high, thus playing a fool-proofing effect.

As shown in FIG. 13, in one embodiment, a number of the first connecting blocks 300*a* is multiple, and the first connecting blocks 300*a* are mirror symmetrical with a first symmetry plane, and the first symmetry plane is a plane constructed in a length direction and a width direction of the connector 100.

It can be understood that by arranging the first connecting block 300*a* which are mirror symmetrical with the first symmetry plane, as shown in a placing state in FIG. 2, the first connecting block 300*a* can still maintain the magnetic connection with the second connecting block 300*b* after the connector 100 is turned over by 180 degrees along the axis parallel to the horizontal plane.

In other embodiments, the first symmetry plane may also be perpendicular to the accommodating cavity 211. In this case, the connector 100 is of a left-right symmetry structure, which will not be described here.

Specifically, the connector 100 may be a rectangular body, a parallelogram body, a square body, a triangle body, a cylinder, a trapezoid body and other structures. In some embodiments, the connector 100 may also be a specialshaped body, so as to keep the magnetic matching with the second connecting block 300*b* after the connector 100 is turned over.

Further, an orthogonal projection of the connector 100 on the carrier 200 is central symmetrical or mirror symmetrical; and/or, an orthographic projection of the first connecting block 300*a* on the carrier 200 is central symmetrical or mirror symmetrical.

Specifically, in this embodiment, the orthogonal projection of the connector 100 or the first connecting block 300*a* on the carrier 200 may be rectangular, parallelogram, square, triangular, circular and other structures, so that magnetic matching stability of the connector 100 after being turned over and the second connecting block 300*b* can be further improved.

It should be noted that, in this embodiment, the connector 100 may be mirror symmetrical with a second symmetry plane, and the second symmetry plane is perpendicular to the first symmetry plane. The same is applicable to the first connecting block 300*a*, which will not be described in detail here.

In the description of the embodiments of the present disclosure, it should be noted that the orientation or positional relationship indicated by the terms "center", "longitudinal", "transversal", "up", "own", "front", "back", "left", "right", "vertical", "horizontal", "top", "bottom", "inside", "outside" and the like is based on the orientation or positional relationship shown in the drawings, only for the convenience of describing the present disclosure and simplifying the description, and does and not indicate or imply that the indicated device or element must have a specific orientation, or be constructed and operated in a specific orientation. Therefore, the terms should not be construed as limiting the present disclosure. Moreover, the terms "first", "second" and "third" are used for descriptive purposes only and cannot be understood as indicating or implying relative importance.

In the description of the embodiments of the present disclosure, it should be noted that terms such as "connected" and "connection", etc., should be understood broadly, for example, the connection may be fixed connection, or detachable connection or integral connection; may be mechanical connection, and may also be electrical connection; and may be direct connection, and may also be indirect connection through an intermediate medium. The specific meaning of the above terms in the embodiments of the present disclosure, can be understood in a specific case by those of ordinary skills in the art.

In the embodiments of the present disclosure, unless otherwise specified and limited, a first feature "upper" or "under" a second feature may be that the first and second features are in direct contact, or the first and second features are in indirect contact through an intermediate medium. Moreover, the first feature "on," "above," and "over" the second feature may be that the first feature is directly on or obliquely above the second feature, or simply mean that the first feature is at a higher level than the second feature. The first feature "under," "below," and "beneath" the second feature may be that the first feature is directly under or obliquely under the second feature, or may simply mean that the first feature is at a lesser elevation than the second feature.

In the description of this specification, descriptions referring to the terms "one embodiment", "some embodiments", "examples", "specific examples" or "some examples" mean that specific features, structures, materials or characteristics described in connection with this embodiment or example are included in at least one embodiment or example of the embodiments of the present disclosure. In this specification, the schematic expressions of the above terms are not necessarily aimed at the same embodiment or example. Moreover, the specific features, structures, materials or characteristics described may be combined in any one or more embodiments or examples in a suitable manner. In addition, those skilled in the art can combine and merge different embodiments or examples and features of different embodiments or examples described in this specification without contradicting each other.

Finally, it should be explained that the above embodiments are only used to illustrate the technical solutions of the present disclosure, but not to limit the technical solutions. Although the present disclosure has been described in detail with reference to the foregoing embodiments, it should be understood by those of ordinary skills in the art that they can still modify the technical solutions described in the foregoing embodiments or replace some technical features with equivalents. However, these modifications or substitutions do not make the essence of the corresponding technical solutions deviate from the spirit and scope of the technical solutions of various embodiments of the present disclosure.

The invention claimed is:

1. A quick-disassembly device for a camera, comprising:

a carrier provided with an accommodating cavity and a limiting cavity which are in communication with each other;

a connector movably arranged relative to the carrier, wherein at least an entering state and a locking state are provided on a moving path of the connector, such that in the entering state, the connector is at least partially accommodated in the accommodating cavity, and in the locking state, the connector is at least partially accommodated in the limiting cavity and relatively fixed with the carrier; and a limiting assembly, comprising a first connecting block and a second connecting block, wherein the first connecting block is arranged in the connector, and the second connecting block is arranged on the carrier; and in the locking state, the connector is abutted against an inner wall of the limiting cavity under a magnetic force provided by the first connecting block and the second connecting block, and is fixed in the limiting cavity.

2. The quick-disassembly device according to claim 1, wherein the first connecting block is a first magnetic piece and the second connecting block is a second magnetic piece; the first magnetic piece is provided with a first magnetic pole and a second magnetic pole with different polarities, the second magnetic piece is provided with a third magnetic pole and a fourth magnetic pole with different polarities, and the first magnetic pole and the third magnetic pole have the same magnetism, and the first magnetic pole and the second magnetic pole are arranged along a direction from the accommodating cavity to the limiting cavity; in the entering state, the second magnetic pole and the third magnetic pole attract each other, and in the locking state, the first magnetic pole and the fourth magnetic pole attract each other, while the second magnetic pole has the same polarity as the fourth magnetic pole, and drives the connector to be abutted against the inner wall of the limiting cavity.

3. The quick-disassembly device according to claim 2, wherein the second magnetic piece comprises a first magnetic part and a second magnetic part, the first magnetic part and the second magnetic part are sequentially arranged along the direction from the accommodating cavity to the limiting cavity, the third magnetic pole is located on one side of the first magnetic part towards the accommodating cavity, and the fourth magnetic pole is located on one side of the second magnetic part towards the limiting cavity; the first magnetic part is further provided with a sixth magnetic pole, the sixth magnetic pole is located on one side of the third magnetic pole far from the accommodating cavity, the second magnetic part is further provided with a fifth magnetic pole, and the fifth magnetic pole is located on one side of the fourth magnetic pole far from the limiting cavity.

4. The quick-disassembly device according to claim 3, wherein the first magnetic part and the second magnetic part are integrally formed, and the second magnetic part is made by multipole magnetizing processing; or, the first magnetic part and the second magnetic part are separately arranged.

5. The quick-disassembly device according to claim 2, wherein the carrier comprises a carrier body and a limiting flange, the accommodating cavity is opened on the carrier body, and the limiting flange at least partially extends towards an inner side of the carrier body and encloses with the carrier body to form the limiting cavity; the connector comprises a connector body and a limiting peripheral part, the limiting peripheral part is convexly arranged on an outer wall of the connector body, and in the locking state, the limiting peripheral part is abutted against an inner side of the limiting flange under the drive of the limiting assembly.

6. The quick-disassembly device according to claim 5, wherein the limiting flange comprises a limiting part and a guide part, the guide part is connected to the limiting part and the guide part extends from the carrier body to the accommodating cavity, the limiting part extends from the carrier body to the limiting cavity, and when the connector is switched between the entering state and the locking state, the connector is in sliding fit with the guide part; and in the locking state, the limiting part is abutted against the limiting peripheral part.

7. The quick-disassembly device according to claim 5, wherein the carrier further comprises limiting protrusions, the limiting protrusions are arranged in the accommodating cavity, and in the locking state, one end of the connector far from the limiting cavity is abutted against the limiting protrusions, a number of the limiting protrusions is at least two, and two of the limiting protrusions are symmetrically arranged on two opposite side walls of the accommodating cavity.

8. The quick-disassembly device according to claim 5, wherein the connector further comprises a clamping part, and the clamping part is convexly arranged at a front end of the connector body; the carrier body is provided with a clamping slot communicated with the limiting cavity, and the clamping part is at least partially accommodated in the clamping slot in the locking state.

9. The quick-disassembly device according to claim 8, wherein the quick-disassembly device further comprises a pulling rope, the pulling rope passes through the connector from the clamping part, and in the locking state, the pulling rope passes through the clamping slot.

10. The quick-disassembly device according to claim 1, wherein the first connecting block is a first magnetic piece, and the first magnetic piece is magnetically attracted with the second connecting block, and in the locking state, the connector is fixed on the carrier by a magnetic action of the limiting assembly.

11. The quick-disassembly device according to claim 10, wherein the second connecting block is made of a ferromagnetic material.

12. The quick-disassembly device according to claim 10, wherein the second connecting block is a second magnetic piece; the first magnetic piece is provided with a first magnetic pole and a second magnetic pole with different polarities, the second magnetic piece is provided with a third magnetic pole and a fourth magnetic pole with different polarities, and the first magnetic pole and the fourth magnetic pole have the same magnetism; in the entering state, polarities of the second magnetic pole and the third magnetic pole are different, and in the locking state, the first magnetic pole and the third magnetic pole repel each other and drive the connector to be abutted against the inner wall of the limiting cavity; wherein a direction of the first magnetic pole towards the second magnetic pole is perpendicular to a direction of the third magnetic pole towards the fourth magnetic pole.

13. The quick-disassembly device according to claim 10, wherein a number of the first connecting blocks is two, and the two first connecting blocks are symmetrically arranged on two opposite sides of the connector; in the locking state, one of the first connecting blocks is located on one side of the connector towards the second connecting block, and the other first connecting block is located on one side of the connector far from the second connecting block.

14. The quick-disassembly device according to claim 1, wherein the first connecting block is a first magnetic piece and the second connecting block is a second magnetic piece; the first magnetic piece is provided with a first magnetic pole and a second magnetic pole with different polarities, the second magnetic piece is provided with a third magnetic pole and a fourth magnetic pole with different polarities, and the first magnetic pole and the third magnetic pole have the same magnetism; in the entering state, the second magnetic pole and the fourth magnetic pole repel each other, and in the locking state, the first magnetic pole and the fourth magnetic pole attract each other, while the second magnetic pole and the third magnetic pole attract each other, and drive the connector to be abutted against the inner wall of the limiting cavity; wherein a direction of the first magnetic pole towards the second magnetic pole is parallel to a direction of the third magnetic pole towards the fourth magnetic pole.

15. The quick-disassembly device according to claim 10, wherein the second connecting block is a second magnetic piece; the first magnetic piece is provided with a first magnetic pole and a second magnetic pole with different polarities, the second magnetic piece is provided with a third magnetic pole and a fourth magnetic pole with different polarities, and the first magnetic pole and the third magnetic pole have the same magnetism; the third magnetic pole is located on one side towards the limiting cavity; in the entering state, the second magnetic pole and the third magnetic pole attract each other, and in the locking state, the first magnetic pole and the third magnetic pole repel each other and drive the connector to be abutted against the inner wall of the limiting cavity; wherein a direction of the first magnetic pole towards the second magnetic pole is perpendicular to a direction of the third magnetic pole towards the fourth magnetic pole.

16. The quick-disassembly device according to claim 2, wherein the connector is mirror symmetrical with a first symmetry plane, and the first symmetry plane is a plane constructed in a length direction and a width direction of the connector.

17. The quick-disassembly device according to claim 1, wherein a number of the first connecting blocks is multiple, the first connecting blocks are mirror symmetrical with a first symmetry plane, and the first symmetry plane is a plane constructed in a length direction and a width direction of the connector.

18. The quick-disassembly device according to claim 1, wherein during the movement of the connector from the entering state to the locking state, the connector reversely flips relative to the carrier towards a direction close to the second connecting block; or during the movement of the connector from the entering state to the locking state, the connector moves in a direction parallel to the second connecting block.

19. The quick-disassembly device according to claim 18, wherein a rear side of the connector is provided with a shifting slot.

20. An assembling method of the quick-disassembly device according to claim 2, wherein the assembling method comprises:

in the entering state, at least partially accommodating the connector in the accommodating cavity, wherein the connector is connected with the carrier through attraction of the second magnetic pole and the third magnetic pole;

pushing the connector to move towards the limiting cavity, wherein the first magnetic pole and the third magnetic pole repel each other, and the second magnetic pole and the fourth magnetic pole repel each other to prevent the connector from continuously moving; and continuously pushing the connector to the locking state, wherein the connector is at least partially accommodated in the limiting cavity, and the first magnetic pole and the fourth magnetic pole attract each other, so that the connector is relatively fixed with the carrier.

* * * * *